US009347024B2

(12) United States Patent
Smith et al.

(10) Patent No.: US 9,347,024 B2
(45) Date of Patent: May 24, 2016

(54) CALCIUM SEQUESTERING COMPOSITION

(75) Inventors: Tyler N. Smith, Missoula, MT (US); Richard Shirley, Missoula, MT (US)

(73) Assignee: Rivertop Renewables, Inc., Missoula, MT (US)

( * ) Notice: Subject to any disclaimer, the term of this patent is extended or adjusted under 35 U.S.C. 154(b) by 35 days.

(21) Appl. No.: 13/452,560

(22) Filed: Apr. 20, 2012

(65) Prior Publication Data

US 2012/0277141 A1 Nov. 1, 2012

Related U.S. Application Data

(60) Provisional application No. 61/477,774, filed on Apr. 21, 2011.

(51) Int. Cl.

| | |
|---|---|
| ***C11D 3/04*** | (2006.01) |
| ***C11D 3/20*** | (2006.01) |
| ***C11D 7/04*** | (2006.01) |
| ***C11D 7/26*** | (2006.01) |
| ***C11D 7/22*** | (2006.01) |
| ***C11D 7/10*** | (2006.01) |

(52) U.S. Cl.

CPC ..... *C11D 3/2086* (2013.01); *C11D 3/046* (2013.01); *C11D 3/2075* (2013.01); *C11D 3/2079* (2013.01); *C11D 3/2082* (2013.01); *C11D 7/10* (2013.01); *C11D 7/22* (2013.01); *C11D 7/265* (2013.01)

(58) Field of Classification Search

CPC .. C11D 3/2075; C11D 3/2079; C11D 3/2082; C11D 3/2086; C11D 7/22

USPC ..... 510/238, 302, 320, 361, 477, 488, 533

See application file for complete search history.

(56) References Cited

U.S. PATENT DOCUMENTS

| | | | | |
|---|---|---|---|---|
| 1,520,885 | A | | 12/1924 | Rankin |
| 2,314,831 | A | | 3/1943 | Kamlet et al. |
| 2,380,196 | A | | 7/1945 | Solomon |
| 2,419,019 | A | | 4/1947 | Hales |
| 2,436,659 | A | | 2/1948 | Mehltretter et al. |
| 2,472,168 | A | | 6/1949 | Mehltretter et al. |
| 2,529,177 | A | | 11/1950 | Nieland |
| 2,529,178 | A | | 11/1950 | Nieland |
| 3,242,207 | A | | 3/1966 | Ulrich et al. |
| 3,346,623 | A | | 10/1967 | Young |
| 3,362,885 | A | | 1/1968 | Harned |
| 3,589,859 | A | | 6/1971 | Foroulis |
| 3,652,396 | A | | 3/1972 | Tanaka et al. |
| 3,696,044 | A | | 10/1972 | Rutledge |
| 3,711,246 | A | | 1/1973 | Foroulis |
| 3,798,168 | A | | 3/1974 | Tumerman et al. |
| 3,819,659 | A | | 6/1974 | Baldwin et al. |
| 3,951,877 | A | | 4/1976 | Okumura et al. |
| 4,000,083 | A | | 12/1976 | Heesen |
| 4,102,799 | A | | 7/1978 | Finck |
| 4,108,790 | A | | 8/1978 | Foroulis |
| 4,120,655 | A | | 10/1978 | Crambes |
| 4,129,423 | A | | 12/1978 | Rubin |
| 4,485,100 | A | | 11/1984 | Hochstrasser et al. |
| 4,512,552 | A | | 4/1985 | Katayama et al. |
| 4,833,230 | A | | 5/1989 | Kiely et al. |
| 4,834,793 | A | | 5/1989 | Schneider et al. |
| 4,845,123 | A | | 7/1989 | Walaszek |
| 5,017,485 | A | | 5/1991 | Bringer-Meyer et al. |
| 5,256,294 | A | | 10/1993 | van Reis |
| 5,264,123 | A | | 11/1993 | Bailey |
| 5,279,756 | A | | 1/1994 | Savio et al. |
| 5,312,967 | A | | 5/1994 | Kiely et al. |
| 5,329,044 | A | | 7/1994 | Kiely et al. |
| 5,330,683 | A | | 7/1994 | Sufrin |
| 5,364,644 | A | | 11/1994 | Walaszek |
| 5,376,499 | A | | 12/1994 | Hammerschmidt et al. |
| 5,434,233 | A | | 7/1995 | Kiely et al. |
| 5,473,035 | A | | 12/1995 | Kiely et al. |
| 5,478,374 | A | | 12/1995 | Kiely |
| 5,531,931 | A | | 7/1996 | Koefod |
| 5,561,160 | A | | 10/1996 | Walaszek |
| 5,562,828 | A | | 10/1996 | Olsen et al. |
| 5,599,977 | A | | 2/1997 | Kiely et al. |
| 5,891,225 | A | | 4/1999 | Mishra |
| 5,958,867 | A | * | 9/1999 | Lamberti et al. ..... 510/465 |
| 5,999,977 | A | | 12/1999 | Riddle |
| 6,049,004 | A | | 4/2000 | Kiely et al. |

(Continued)

FOREIGN PATENT DOCUMENTS

| | | |
|---|---|---|
| CA | 2188063 | 4/1998 |
| CN | 1131651 | 9/1996 |

(Continued)

OTHER PUBLICATIONS

Abbadi et al., New Ca-Sequestering Materials Based on the Oxidation of the Hydrolysis Products of Lactose, Green Chem, 1999, 231-235.

Wilham et al., Organic Acids as Builders in Linear Alkylbenzene Sulfonate Detergent Formulations, J. Am. Oil Chem. Soc., 1971, 48(11), 682-683.

Lowe et al., Soaps and Detergents—The Inorganic Components, J. Am. Oil Chem. Soc., 1978, 55, 32-35.

Van Duin et al., Synergic Coordination of Calcium in Borate-Polyhydroxycarboxylate Systems, Carb. Res., 1987, 162, 65-78.

Van Duin et al., Studies on borate esters. Part 8. Interactions of cations with oxyacid anion-bridged esters of D-glucarate in alkaline media, J. Chem. Soc. Dalton Trans., 1987, 8, 2051-2057.

International Search Report and Written Opinion for Application No. PCT/US2012/034538 dated Jul. 10, 2012 (11 pages).

(Continued)

*Primary Examiner* — Gregory R Delcotto

(74) *Attorney, Agent, or Firm* — Lisa V. Mueller; Michael Best & Friedrich LLP

(57) ABSTRACT

This invention relates to compositions which are capable of sequestering calcium ions and are derived in part from renewable carbohydrate feedstocks. The calcium sequestering compositions are mixtures containing one or more hydroxycarboxylic acid salts, one or more oxoacid anion salts, and one or more citric acid salts.

11 Claims, No Drawings

(56) References Cited

U.S. PATENT DOCUMENTS

| | | | | |
|---|---|---|---|---|
| 6,156,226 | A | 12/2000 | Klyosov et al. | |
| 6,228,825 | B1 | 5/2001 | Gorlin et al. | |
| 6,372,410 | B1 | 4/2002 | Ikemoto et al. | |
| 6,498,269 | B1 | 12/2002 | Merbouh et al. | |
| 6,686,325 | B2 | 2/2004 | Ruhr et al. | |
| 6,831,195 | B2 | 12/2004 | Nishimura et al. | |
| 6,843,931 | B2 | 1/2005 | Sapienza | |
| 6,861,009 | B1 | 3/2005 | Leist | |
| 6,894,135 | B2 | 5/2005 | Kiely et al. | |
| 6,919,478 | B2 | 7/2005 | Kawato et al. | |
| 7,125,441 | B1 | 10/2006 | Furman et al. | |
| 7,314,906 | B2 | 1/2008 | Kiely et al. | |
| 7,658,861 | B2 | 2/2010 | Koefod | |
| 7,692,041 | B2 | 4/2010 | Kiely et al. | |
| 8,153,573 | B2 | 4/2012 | Miralles et al. | |
| 8,303,721 | B2 * | 11/2012 | Warkotsch et al. | 134/25.2 |
| 8,679,364 | B2 | 3/2014 | Pylkkanen | |
| 9,096,787 | B2 | 8/2015 | Presta | |
| 2002/0068836 | A1 | 6/2002 | Haupfear et al. | |
| 2003/0109394 | A1 * | 6/2003 | Ruhr et al. | 510/202 |
| 2003/0168625 | A1 | 9/2003 | Sapienza et al. | |
| 2003/0176305 | A1 * | 9/2003 | Hoyt et al. | 510/245 |
| 2004/0025908 | A1 | 2/2004 | Douglas et al. | |
| 2004/0028655 | A1 | 2/2004 | Nelson et al. | |
| 2004/0185562 | A1 | 9/2004 | Schroeder et al. | |
| 2005/0202981 | A1 * | 9/2005 | Eveland et al. | 508/295 |
| 2005/0202989 | A1 | 9/2005 | Wilson | |
| 2005/0230658 | A1 | 10/2005 | Koefod | |
| 2007/0037727 | A1 * | 2/2007 | Fiore et al. | 510/488 |
| 2007/0102157 | A1 | 5/2007 | Roddy et al. | |
| 2007/0278446 | A1 | 12/2007 | Koefod | |
| 2008/0033205 | A1 | 2/2008 | Kiely et al. | |
| 2008/0099716 | A1 | 5/2008 | Koefod | |
| 2008/0287334 | A1 | 11/2008 | Smith et al. | |
| 2008/0302737 | A1 | 12/2008 | Denkewicz, Jr. et al. | |
| 2009/0131259 | A1 | 5/2009 | Kiely | |
| 2009/0250653 | A1 | 10/2009 | Kiely | |
| 2010/0041574 | A1 * | 2/2010 | Warkotsch et al. | 510/191 |
| 2010/0119152 | A1 | 5/2010 | Lv et al. | |
| 2010/0130774 | A1 | 5/2010 | Wan et al. | |
| 2010/0191002 | A1 | 7/2010 | Kiely | |
| 2010/0240566 | A1 * | 9/2010 | Meine et al. | 510/276 |
| 2010/0242997 | A1 | 9/2010 | Smith et al. | |
| 2010/0256036 | A1 * | 10/2010 | Benda et al. | 510/299 |
| 2011/0226288 | A1 * | 9/2011 | Warkotsch et al. | 134/25.2 |
| 2011/0232692 | A1 * | 9/2011 | Zipfel et al. | 134/25.2 |
| 2011/0263905 | A1 | 10/2011 | Purola | |
| 2011/0269662 | A1 * | 11/2011 | Miralles | 510/477 |
| 2011/0312871 | A1 | 12/2011 | Miralles et al. | |
| 2012/0035356 | A1 | 2/2012 | Kiely | |
| 2012/0238005 | A1 * | 9/2012 | Wieland et al. | 435/264 |
| 2012/0295986 | A1 | 11/2012 | Smith | |
| 2012/0305832 | A1 | 12/2012 | Kiely | |
| 2013/0090281 | A1 | 4/2013 | Feenstra et al. | |
| 2014/0275621 | A1 | 9/2014 | Donen | |
| 2014/0275622 | A1 | 9/2014 | Donen | |
| 2014/0275623 | A1 | 9/2014 | Donen | |

FOREIGN PATENT DOCUMENTS

| | | |
|---|---|---|
| CN | 1970488 | 5/2007 |
| DE | 2016686 | 11/1970 |
| DE | 1929968 | 12/1970 |
| DE | 117492 | 1/1976 |
| DE | 3331751 | 3/1984 |
| DE | 3519884 | 1/1986 |
| EP | 0652305 | 5/1995 |
| EP | 0758678 | 2/1997 |
| EP | 0819653 | 1/1998 |
| EP | 1201617 | 5/2002 |
| FR | 2054945 | 6/1971 |
| FR | 2115300 | 8/1972 |
| GB | 866840 | 5/1961 |
| GB | 2405636 | 9/2003 |
| JP | 47048091 | 12/1972 |
| JP | S50-045744 | 4/1975 |
| JP | S51011030 | 1/1976 |
| JP | 51041578 | 11/1976 |
| JP | 54043840 | 4/1979 |
| JP | S57192270 | 11/1982 |
| JP | S58091174 | 5/1983 |
| JP | 60-50188 | 3/1985 |
| JP | S60050188 | 3/1985 |
| JP | 60108352 | 6/1985 |
| JP | 60112676 | 6/1985 |
| JP | 63248782 | 10/1988 |
| JP | 04214057 | 8/1992 |
| JP | H06306652 | 11/1994 |
| JP | H09104687 | 4/1997 |
| JP | H09-227900 | 9/1997 |
| JP | 2004123465 | 4/2003 |
| JP | 2003306369 | 10/2003 |
| JP | 2008054806 | 3/2008 |
| KR | 20020066275 | 8/2002 |
| PL | 98149 | 8/1978 |
| RO | 69880 | 4/1981 |
| WO | 92/07108 | 4/1992 |
| WO | WO 00/34221 | 6/2000 |
| WO | WO 2004/052958 | 6/2004 |
| WO | WO 2004/052959 | 6/2004 |
| WO | WO 2008/021054 | 2/2008 |
| WO | WO 2009/065143 | 5/2009 |
| WO | 2010/086832 | 8/2010 |
| WO | WO2011/032988 | * 3/2011 |
| WO | 2011/100344 | 8/2011 |
| WO | 2011/138719 | 11/2011 |
| WO | WO 2012/065001 | 5/2012 |
| WO | WO 2012/145688 | 10/2012 |
| WO | WO 2012/145690 | 10/2012 |
| WO | 2013/090090 | 6/2013 |

OTHER PUBLICATIONS

Abd El Kader, J.M. et al., ""Corrosion inhibition of mild steel by sodium tungstate in neutral solution. Part 3. Coinhibitors and synergism,"" British Corrosion Journal, 33, 152-157 (1998) Chern Abstr AN 1998:796697.

Abdallah, M. "Sodium gluconate, triethanolamine and their mixtures as corrosion inhibitors of carbon steel in 3.5% NaC1 solution," Journal of the Electrochemical Society of India, 48, 121-127, (1999) Chern Abst An 1999:374923.

Allcock, H.R. et al., "Effect of nonstoichiometric reactant ratios on linear condensation polymers," Contemporary Polymer Chemistry, 2nd Edition, Prentice-Hall, New Jersey (1990) Part II, 274-275.

Billmeyer, F.W., Jr., "Molecular weight and molecular-weight distribution," Textbook of Polymer Science, 3rd Edition, Wiley Interscience, New York (1984) 38-47.

Cantrell, C. E., et al., ""s-Dicarbonyl Sugars. 5. A Novel Synthesis of a Branched- Chain Cyclitol,"" J. Org. Chern. (1977) 42(22):3562-3567.

Carter, Andy, "Modifications in the Preparation of Glucaric Acid and Some 4-alkyl-4-azaheptane-1 ,7-diamines," 1998, Thesis, University of Alabama, Birmingham, AL, p. 18-20.

Chen, L., "Experimental and Theoretical Studies Concerned with Synthetic Acyclic Carbohydrate Based Polyamides," A Dissertation, University of Alabama at Birmingham (1992).

Chen, L. et al., "Synthesis of steroregular head-tail hydroxylated nylons derived from D-glucose," J. Org. Chem. (1996) 61:5847-5851.

Collepardi, M.M.; "Concrete Admixture Handbook: Properties, Science and Technology", 2nd Edition, Ramachandran,V.S. Editor,Noyes Publications, Park Ridge,NJ (1995) p. 286-409.

Cotton, F.A. et al., Advanced Inorganic Chemistry, 1988, p. 341-353, John Wiley and Sons, New York.

CRC Handbook of Chemistry and Physics, edited by Weast et al., 64th Edition, 1983-84, Boca Raton, Florida, p. B-117.

Hashimoto et al., "Macromolecular synthesis from caccharic lactones. Ring-opening polyaddition of D-glucaro- and D-mannaro-1,4:6,3-dilactones with alkylenediamines," J. Polym. Sci. Part A: Polym. Chem. (1993) 31:3141-3149.

(56) References Cited

OTHER PUBLICATIONS

Hashimoto, K. et al., "Ring-opening polyaddition of D-glucaro-1,4:6,3-dilactone with p-zylylenediamine," Macromol. Chem. Rapid Commun. (1990) 11:393-396.
Haworth et al., "Lactones of mannosaccharic acid, Part I. 2: 5-dimethyl Δ4-manno-saccharo-3: 6-lactone 1-methyl ester, an analogue of ascorbic acid," J. Chem. Soc. London (1944) 56:217-224.
Haworth, W.N. et al., ""Some Derivatives of Glucosaccharic Acids,"" J. Chern. Soc. (1944) 25:65-76.
Kiely et al., "Hydroxylated nylons based on unprotected esterified D-glucaric acid by simple condensation reactions," J. Am. Chem. Soc. (1994) 116(2):571-578.
Kirk-Othmer Encyclopedia of Chemical Technology, 3rd Edition, Wiley, New York, vol. 16, 617-634, "Hydrocarbon Resins" to "Hypnotics, Sedatives, Anticonvulsants".
Korzh, E.N. et al., "Acidity and corrosion activity of brine refrigeratnts based on calcium chloride," Zhurnal Prikladnoi Khimii Journal (Russian) (1981) 54:2404-2407, Chern. Abstr. AN 1982-147045.
Lachman, A., "Dihydroxy-Tartaric Acid," Amer. Chern. Soc. (1921) 43:2091-2097.
Lewis, B.A. et al., Chapter 13, "Galactaric acid and its derivatives," Methods in Carbohydrate Chemistry, R.L. Whistler et al., editors, (1953) II:38-46.
Lin, "Diverse Applications of Carbohydrate Acids in Organic Synthesis," a Dissertation, University of Alabama at Birmingham (1987) p. 48-50, 72-74.
Mainhardt, H., "N20 Emissions from Adipic Acid and Nitric Acid Production," IPCC Good Practice Guidance and Uncertainty Management in National Greenhouse Gas Inventories (2001).
Marukame, K., S.Fushoku Burnon linkai Shiryo(Nippon Xairyo Gakkai), journal written in Japanese, 173, 1-8, (1993) Chern. Abstr. AN 1993:543767.
Mehletretter, C.L., "D-Giucaric Acid," Methods in Carbohydrate Chemistry, 1963, p. 46-48, vol. II, Academic Press, New York.
Mehltretter, C.L. et al., "Saccharic and Oxalic Acids by the Nitric Acid Oxidation of Dextrose," Agric. and Food Chern. (1953) 1(12):779-783.
Merbough, N. et al., "4-AcNH-tempo-Catalyzed Oxidation of Aldoses to Aldaric Acids Using Chlorine or Bromine as Terminal Oxidants," J. Carbohydr. Chem., 2002, 21:.66-77.
Mor, E. et al., "Steel corrosion inhibition in seawater by calcium organic compounds," Annali deii'University di Ferrara, Sezione 5; Chimica Pura ed Applicata, Journal in French (1971),Chem Abstr An 1971:414090.
Mor, E. et al., "Zinc gluconate as an inhibitor of the corrosion of mild steel in sea water," Lab Corros. Mar. Met, British Corrosion Journal (1976) 11:199-203 Chem. Abstr. AN 1977:129710.
Mustakas, G.C. et al., "Potassium Acid Saccharate by Nitric Acid Oxidation of Dextrose," Industrial and Engineering Chemistry, Mar. 1954, 427-434.
National Association of Corrosion Engineers (NACE) Standard TM0169-95 as Modified by the Pacific Northwest States, Test Method B, Revision (Apr. 2006).
Ogata, N. et al., "Active polycondensation of diethyl 2,3,4,5-tetrahydroxyadipate with diamines," J. Polym. Sci. Polym. Chem. Ed. (1976) 14:783-792.
Ogata, N. et al., "Copolycondensation of hydroxyl diesters and active diesters with hexamethylenediamine," J. Polym. Sci. Polym. Chem. Ed. (1977) 15:1523-1526.
Ogata, N. et al., "Polycondensation reaction of dimethyl tartrate with hexamethylenediamine in the presence of various matrices," J. Polym. Sci. Polym. Chem. Ed. (1980) 18:939-948.
Ogata, N. et al., "Synthesis of hydrophilic polyamide by active polycondensation," J. Polym. Sci. Polym. Lett. Ed. (1974) 12:355-358.
Ogata, N. et al., "Synthesis of hydrophilic polymide from L-tartarate and diamines by active polycondensation," J. Polym. Sci. Polym. Chem. Ed. (1975) 13:1793-1801.
Ogata, N. et al., "Synthesis of polyamides through active diesters," J. Polym. Sci., Polym. Chem. Ed. (1973) 11:1095-1105.
Ogata, N. et al., "Synthesis of polyesters from active diesters," J. Polym. Sci. Chem. Ed. (1973) 11:2537-2545.
Ogata, N., "New polycondensation systems," Polym. Prepr. (1976) 17:151-156.
Pamuk et al. "The preparation of D-glucaric acid by oxidation of molasses in packed beds" Journal of Chemical Technology and Biotechnology (2001) 76:186-190.
Roper, H., "Selection oxidation of D-glucose: chiral intermediates for industrial utilization," Starch/Starke (1990) 42(9):342-349.
Stanek, J. et al., "Monosaccharide dicarboxylic acids," The Monosaccharides, Academic Press, New York and London (1963) Chapter XXXII, p. 741-752.
Styron, S.D. et al., "MM3(96) conformational analysis of D-glucaramide and x-ray crystal structures of three D-glucaric acid derivatives—models for synthetic poly(alkylene D-glucaramides," J. Carb. Chem. (2002) 21(1&2):27-51.
Sukhotin,A.M. et al., "Corrosion inhibitor for steel in calcium chloride solutions," Zashchita Mettalov, Journal in Russion (1982) 18:268-70, Chem Ab 1982:476671.
Van Duin, M. et al., "Studies on borate esters. Part 5. The system glucarate borate calcium (II) as studied by 1H, 11B, and 13C nuclear magnetic resonance spectroscopy," J. Chem. Soc. (1987) 2(4):473-478.
Werpy, T. et al., Top Value Added Chemicals from Biomass, Voil—Results of Screening for Potential, www.osti.gov/bridge, U.S. Dept. of Energy, Oak Ridge, TN (2004) 76 pages.
Wisconsin Biorefiners Development Initiative and references therein, Biorefining Processes-Fermentation of 6-Carbon Sugars and Starchs, www.wisbiorefine.org/proc/ferments.pdr (Feb. 5, 2007).
Wrubl, C. et al., "Zinc gluconate as an inhibitor of the corrosion of copper and zinc in seawater," 1st Corros. Mar Met, British Corrosion Journal (1983) 18:142-147, Chem. Abstr. AN 1984:11228.
Yahiro et al., "Efficient acid production from raw corn starch," J. Fermentation Bioengineering (1997) 84(4):375-377.
International Preliminary Report on Patentability for Application No. PCT/US2007/017493 dated Feb. 10, 2009.
International Preliminary Report on Patentability for Application No. PCT/US2008/083831 dated May 18, 2010 (8 pages).
International Preliminary Report on Patentability for Application No. PCT/US2011/060264 dated May 23, 2013 (8 pages).
International Search Report and Written Opinion for Application No. PCT/US2012/034542 dated Jul. 10, 2012 (10 pages).
International Search Report for Application No. PCT/US2003/039733 dated May 13, 2004 (2 pages).
International Search Report for Application No. PCT/US2007/017493 dated Feb. 12, 2008.
International Search Report for Application No. PCT/US2011/060264 dated Feb. 10, 2012.
United States Patent Office Action for U.S. Appl. No. 11/890,760 dated Apr. 16, 2009 (7 pages).
United States Patent Office Action for U.S. Appl. No. 11/890,760 dated Jul. 25, 2008 (8 pages).
United States Patent Office Action for U.S. Appl. No. 12/272,732 dated Apr. 26, 2011.
United States Patent Office Action for U.S. Appl. No. 12/272,732 dated Aug. 24, 2010.
United States Patent Office Action for U.S. Appl. No. 12/272,732 dated Dec. 9, 2011.
United States Patent Office Action for U.S. Appl. No. 12/272,732 dated Jul. 6, 2012 (12 pages).
United States Patent Notice of Allowance for U.S. Appl. No. 12/272,732 dated Aug. 9, 2013 (9 pages).
United States Patent Office Action for U.S. Appl. No. 12/442,135 dated May 16, 2012 (7 pages).
United States Patent Office Action for U.S. Appl. No. 12/442,135 dated Oct. 26, 2011 (7 pages).
United States Patent Office Action for U.S. Appl. No. 12/753,721 dated Dec. 12, 2011 (7 pages).
United States Patent Office Action for U.S. Appl. No. 12/753,721 dated May 9, 2013 (8 pages).

(56) References Cited

OTHER PUBLICATIONS

United States Patent Office Notice of Allowance for U.S. Appl. No. 11/890,760 dated Jan. 8, 2010 (6 pages).
United States Patent Office Notice of Allowance for U.S. Appl. No. 12/753,721 dated Aug. 3, 2012 (5 pages).
United States Patent Office Action for U.S. Appl. No. 13/586,953 dated Jul. 1, 2013 (7 pages).
United States Patent Office Action for U.S. Appl. No. 13/586,953 dated Jan. 27, 2014 (7 pages).
U.S. Appl. No. 14/887,635, filed Oct. 20, 2015, Steven Donen.
United States Patent Notice of Allowance for U.S. Appl. No. 14/107,297 dated Dec. 16, 2015.
Co-Pending U.S. Appl. No. 14/727,712, filed Jun. 1, 2015, Rowley et al.
Dorwald, F.Z., Side Reactions in Organic Synthesis. A Guide to Succsesful Synthesis Design, Wiley-VCH Verlag GmbH & Co., Weinheim, Germany (2005) Preface.
International Search Report and Written Opinion for Application No. PCT/US2013/071520 dated Feb. 5, 2014 (12 pages).
International Search Report and Written Opinion for Application No. PCT/US2014/024785 dated Jul. 7, 2014 (13 pages).
United States Patent Office Notice of Allowance for U.S. Appl. No. 13/586,953 dated Aug. 7, 2014 (6 pages).
United States Patent Office Action for U.S. Appl. No. 13/452,578 dated Sep. 23, 2014 (12 pages).
United States Patent Office Action for U.S. Appl. No. 13/452,578 dated Jul. 16, 2015 (16 pages).
United States Patent Office Action for U.S. Appl. No. 14/150,633 dated Sep. 25, 2014 (12 pages).
United States Patent Office Notice of Allowance for U.S. Appl. No. 14/150,633 dated Jun. 8, 2015 (9 pages).
United States Patent Office Action for U.S. Appl. No. 13/294,085 dated Oct. 3, 2014 (18 pages).
United States Patent Office Action for U.S. Appl. No. 13/294,085 dated Apr. 1, 2015 (15 pages).
United States Patent Office Action for U.S. Appl. No. 14/089,054 dated Aug. 15, 2014 (16 pages).
United States Patent Office Notice of Allowance for U.S. Appl. No. 14/089,054 dated Mar. 2, 2015 (7 pages).
United States Patent Office Action for U.S. Appl. No. 14/107,297 dated Mar. 11, 2015 (4 pages).
United States Patent Office Action for U.S. Appl. No. 14/107,297 dated Jun. 19, 2015 (8 pages).
United States Patent Office Action for U.S. Appl. No. 14/205,627 dated Aug. 27, 2014 (25 pages).
United States Patent Office Action for U.S. Appl. No. 14/205,627 dated May 15, 2015 (28 pages).
United States Patent Office Action for U.S. Appl. No. 14/205,832 dated Aug. 27, 2014 (21 pages).
United States Patent Office Action for U.S. Appl. No. 14/205,832 dated May 12, 2015 (27 pages).
United States Patent Office Action for U.S. Appl. No. 14/206,796 dated Nov. 4, 2014 (35 pages).
United States Patent Office Notice of Allowance for U.S. Appl. No. 14/206,796 dated Jul. 17, 2015 (8 pages).
United States Patent Office Action for U.S. Appl. No. 12/422,135 dated Dec. 17, 2014 (8 pages).
United States Patent Office Action for U.S. Appl. No. 14/727,712 dated Jun. 26, 2015 (14 pages).
U.S. Appl. No. 14/849,991 by Donald Kiely, filed Sep. 10, 2015.
U.S. Appl. No. 14/876,148 by Tyler Smith, filed Oct. 6, 2015.
United States Patent Office Action for U.S. Appl. No. 13/294,085 dated Aug. 27, 2015 (6 pages).
International Search Report and Written Opinion for Application No. PCT/US2015/054218 dated Jan. 14, 2016 (13 pages).
United States Patent Office Action for U.S. Appl. No. 14/579,938 dated Jan. 20, 2016 (5 pages).
United States Patent Office Notice of Allowance for U.S. Appl. No. 14/205,627 dated Jan. 21, 2016 (10 pages).
United States Patent Office Action for U.S. Appl. No. 14/205,832 dated Dec. 31, 2015 (18 pages).

* cited by examiner

CALCIUM SEQUESTERING COMPOSITION

CROSS-REFERENCE TO RELATED APPLICATION

This claims priority to U.S. Provisional Patent Application No. 61/477,774, filed on Apr. 21, 2011, the contents of which are herein fully incorporated by reference.

FIELD OF THE INVENTION

This invention relates to compositions which are capable of sequestering calcium ions and are derived in part from renewable carbohydrate feedstocks. The calcium sequestering compositions include one or more hydroxycarboxylic acid salts including hydroxymonocarboxylic acids and hydroxydicarboxylic acids, one or more suitable oxoacid anion salts, and one or more citric acid salts.

BACKGROUND OF THE INVENTION

Hydroxycarboxylic acids and hydroxycarboxylic acid salts have been described as chelating agents capable of sequestering metal ions in solution (Mehltretter, 1953; Abbadi, 1999). Hydroxycarboxylic acid salts as sequestering agents for metal ions such as calcium and magnesium, in general perform poorly compared to common sequestering agents such as sodium tripolyphosphate (STPP), ethylenediaminetetraacetate (EDTA), or nitrilotriacetate (NTA). In spite of low sequestering capacity, hydroxycarboxylic acid salts are of interest because they are typically biodegradable, non-toxic, and derived from renewable resources such as carbohydrates. Therefore, the use of hydroxycarboxylic acid salts as replacement sequestering agents for STPP and EDTA is advantageous, especially in applications where the compounds may be discharged into the environment. The performance of hydroxycarboxylic acid salts as sequestering agents for hard water ions can be boosted by the addition of suitable oxoacid anion compounds such as borate and aluminate. The boost in performance arises from the formation of diester complexes between the two adjacent hydroxyl groups of the hydroxycarboxylic acid salt and the borate or aluminate as described by van Duin et al (Carb. Res. 1987, 162, 65-78 and J. Chem. Soc. Dalton Trans. 1987, 8, 2051-2057). The work of van Duin et al. shows that diester complex formation occurs with compounds containing two vicinal hydroxyl groups, preferably in the threo configuration. The stability of the complexes is pH dependent with improved stability coming at higher pHs. Complexes between salts of hydroxycarboxylic acids and either sodium borate or sodium aluminate have been described as calcium sequestering agents for use in detergent applications (Hessen, U.S. Pat. No. 4,000,083; Tumerman, U.S. Pat. No. 3,798,168; and Miralles et al., U.S. Pat. No. 8,153,573). Therefore it is well known that complexes between salts of polyhydroxycarboxylic acids and suitable oxoacid anion salts such as sodium aluminate and sodium borate are useful as divalent metal ion sequestering agents for use in applications such as detergents. Surprisingly, we have found that the calcium sequestering performance of the complexes between salts of polyhydroxycarboxylic acids and suitable oxoacid anion salts can be improved by the addition of certain sequestering agents such as citrate salts. This is unexpected considering that performance of citrate is not improved by the addition of sodium aluminate or sodium borate as shown by van Duin et al. (*Carb. Res.* 1987, 162, 65-78).

Many chemical compounds that have traditionally been used as metal sequestering agents are phosphorus based. Through environmental regulations, the use of phosphorus compounds in applications where the material is discharged into surface water continues to be restricted. These regulations have created a need for environmentally acceptable materials for use as metal sequestering agents for a variety of applications.

One application in which metal sequestering agents are useful is in detergent formulations. Detergents are cleaning mixtures composed primarily of surfactants, builders, bleaching-agents, enzymes, and fillers. Two of the major components are surfactants and builders. The surfactants are responsible for emulsification of oil and grease while builders are added to extend or improve the cleaning properties of the surfactant. The builder can be a single substance or a mixture of substances and commonly serve multiple functions. An important builder function is the sequestration of metal cations, typically calcium and magnesium cations in hard water. The builders act as water softening agents by sequestering calcium and magnesium cations and thus prevent the formation of water insoluble salts between the cations and anion components in the wash solution, such as surfactants and carbonate. In the case of laundry detergents, builders also help prevent the cations from binding to cotton, a major cause of soil retention on cotton fabrics. Other functions of builders include increasing alkalinity of detergent solutions, deflocculating surfactant micelles, and inhibiting corrosion.

The first builders used in commercial detergents were phosphate salts and phosphate salt derivatives. Sodium tripolyphosphate (STPP) was, at one time, the most common builder in both consumer and industrial detergents. Phosphate builders were also touted as corrosion inhibitors for the metal surfaces of washing machines and dishwashers. Phosphates have been gradually phased out of detergents over the past 40 years primarily due to environmental concerns regarding discharge of phosphate rich waste water into surface waters giving rise to eutrophication and ultimately hypoxia (Lowe, 1978). High performance replacements for phosphates in detergents are still sought after.

Conventional detergents used in the vehicle care, food and beverage (e.g., the dairy, cheese, sugar, meat, food, and brewery and other beverage industries), warewashing and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to aid in soil removal and to sequester metal ions such as calcium, magnesium and iron.

In particular, NTA, EDTA or polyphosphates such as sodium tripolyphosphate and their salts are used in detergents because of their ability to solubilize preexisting inorganic salts and/or soils. When calcium, magnesium and iron salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. In the food and beverage industry, the calcium carbonate residue can affect the acidity levels of foods. The ability of NTA, EDTA and polyphosphates to remove metal ions facilitates the detergency of the solution by preventing hardness precipitation, assisting in soil removal and/or preventing soil redeposition into the wash solution or wash water.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can replace the properties of phosphorous-containing compounds such as phosphates, phosphonates, phosphites, and acrylic phosphinate polymers, as well as non aminocarboxylates such as NTA and EDTA.

SUMMARY OF THE INVENTION

The present invention provides a calcium sequestering composition comprising a combination of at least one salt of a hydroxycarboxylic acid selected from the group consisting of at least one hydroxymonocarboxylic acid salt, at least one hydroxydicarboxylic acid salt, and a combination of at least one hydroxymonocarboxylic acid salt and at least one hydroxydicarboxylic acid salt, at least one suitable oxoacid anion salt (such as, for example, a borate salt or an aluminate salt), and at least one citric acid salt. Generally, the hydroxymonocarboxylic acid salt may include at least one salt of glycolic acid, at least one salt of gluconic acid, and at least one salt of 5-keto-gluconic acid. In one embodiment, the at least one salt of glycolic acid includes sodium glycolate, potassium glycolate, lithium glycolate, zinc glycolate, ammonium glycolate, or mixtures thereof. In another embodiment, the at least one salt of gluconic acid may include sodium gluconate, potassium gluconate, lithium gluconate, zinc gluconate, ammonium gluconate, or mixtures thereof. In a further embodiment, the at least one salt of 5-keto-gluconic acid comprises sodium 5-keto-gluconate, potassium 5-keto-gluconate, lithium 5-keto-gluconate, zinc 5-keto-gluconate, ammonium 5-keto-gluconate, or mixtures thereof.

Further, the hydroxydicarboxylic acid salt may generally include at least one salt of glucaric acid, at least one salt of tartaric acid, at least one salt of tartronic acid, at least one salt of xylaric acid, at least one salt of galactaric acid, or mixtures thereof. In one embodiment, the at least one salt of glucaric acid comprises disodium glucarate, sodium potassium glucarate, dipotassium glucarate, zinc glucarate, diammonium glucarate, dilithium glucarate, lithium sodium glucarate, lithium potassium glucarate, or mixtures thereof. In another embodiment, the at least one salt of tartaric acid comprises disodium tartrate, sodium potassium tartrate, dipotassium tartrate, dilithium tartrate, lithium sodium tartrate, lithium potassium tartrate, zinc tartrate, diammonium tartrate, or mixtures thereof. In yet another embodiment, the at least one salt of tartronic acid comprises disodium tartronate, sodium potassium tartronate, dipotassium tartronate, dilithium tartronate, lithium sodium tartronate, lithium potassium tartronate, zinc tartronate, diammonium tartronate, or mixtures thereof.

It is recognized that the at least one salt of a hydroxycarboxylic acid selected from the group consisting of at least one hydroxymonocarboxylic acid salt, at least one hydroxydicarboxylic acid salt, and a combination of at least one hydroxymonocarboxylic acid salt and at least one hydroxydicarboxylic acid salt, may include a mixture of at least one glucarate salt, at least one gluconate salt, at least one 5-keto-gluconate salt, at least one tartrate salt, at least one tartronate salt, and at least one glycolate salt. In one embodiment, the mixture of hydroxycarboxylic acids may include about 30% to about 75% of the at least one glucarate salt, about 0% to about 20% of the at least one gluconate salt, about 0% to about 10% of the at least one 5-keto-gluconate salt, about 0% to about 10% of the at least one tartrate salt, about 0% to about 10% of the at least one tartronate salt, and about 0% to about 10% of the at least one glycolate salt. The mixture comprises about 40% to about 60% of the at least one glucarate salt, about 5% to about 15% of the at least one gluconate salt, about 3% to about 9% of the at least one 5-keto-gluconate salt, about 5% to about 10% of the at least one tartrate salt, about 5% to about 10% of the at least one tartronate salt, and about 1% to about 5% of the at least one glycolate salt. In another embodiment, the mixture includes about 45% to about 55% of the at least one glucarate salt, about 10% to about 15% of the at least one gluconate salt, about 4% to about 6% of the at least one 5-keto-gluconate salt, about 5% to about 7% of the at least one tartrate salt, about 5% to about 7% of the at least one tartronate salt, and about 3% to about 5% of the at least one glycolate salt. In still another embodiment, the mixture includes about 50% of the at least one glucarate salt, about 15% of the at least one gluconate salt, about 4% of the at least one 5-keto-gluconate salt, about 6% of the at least one tartrate salt, about 6% of the at least one tartronate salt, and about 5% of the at least one glycolate salt.

The calcium sequestering composition generally includes from about 25% to about 75% by weight of the at least one salt of hydroxycarboxylic acid, from about 1% to about 50% by weight of the at least one citric acid salt, and from about 1% to about 50% by weight of the at least one suitable oxoacid anion salt. In one embodiment, the composition includes from about 40% to about 60% by weight of the at least one salt of hydroxycarboxylic acid, from about 10% to about 35% by weight of the at least one citric acid salt, and from about 10% to about 35% by weight of the at least one suitable oxoacid anion salt. In an additional embodiment, the composition comprises about 50% by weight of the at least one salt of hydroxycarboxylic acid, about 20% by weight of the at least one suitable oxoacid anion salt, and about 30% by weight of the at least one citric acid salt.

Suitable salts of oxoacid anions include sodium and potassium salts of borate, aluminate, stannate, germanate, molybdate, antimonate, or mixtures thereof. It is further recognized that the at least one aluminum salt of the calcium sequestering composition may include sodium aluminate, aluminum chloride, or mixtures thereof. The at least one citric acid salt may include sodium citrate, potassium citrate, calcium citrate, magnesium citrate, or mixtures thereof.

In another aspect, the current invention provides a method of sequestering calcium ions from a medium comprising the administration of a composition having a combination of at least one salt of a hydroxycarboxylic acid selected from the group consisting of at least one hydroxymonocarboxylic acid salt, at least one hydroxydicarboxylic acid salt, and a combination of at least one hydroxymonocarboxylic acid salt and at least one hydroxydicarboxylic acid salt, at least one suitable oxoacid anion salt, and at least one citric acid salt. The at least one salt of a hydroxycarboxylic acid may include a salt of glucaric acid, a salt of gluconic acid, a salt of 5-keto-gluconic acid, a salt of tartaric acid, a salt of tartronic acid, a salt of glycolic acid, a salt of glyceric acid, a salt of xylaric acid, a salt of galactaric acid, or mixtures thereof. Additionally, the at least one salt of a hydroxycarboxylic acid may include a mixture of at least one glucarate salt, at least one gluconate salt, at least one 5-keto-gluconate salt, at least one tartrate salt, at least one tartronate salt, and at least one glycolate salt. Suitable salts of oxoacid anions include sodium and potassium salts of borate, aluminate, stannate, germanate, molybdate, antimonate, or mixtures thereof. Additionally, the at least one aluminum salt may include sodium aluminate, aluminum chloride, or mixtures thereof. The at least one citric acid salt may include sodium citrate, potassium citrate, calcium citrate, magnesium citrate, or mixtures thereof.

In another aspect, the current invention provides a detergent composition including a calcium sequestering composition of at least one salt of a hydroxycarboxylic acid selected from the group consisting of at least one hydroxymonocarboxylic acid salt, at least one hydroxydicarboxylic acid salt, and a combination of at least one hydroxymonocarboxylic acid salt and at least one hydroxydicarboxylic acid salt; at least one oxoacid anion salt; and, at least one citric acid salt. The detergent composition may further include one or more additional functional materials, such as for example, a rinse aid, a bleaching agent, a sanitizer/anti-microbial agent, activators, detergent builders or fillers, pH buffering agents, fabric relaxants, fabric softeners, soil releasing agents, defoaming agents, anti-redeposition agents, stabilizing agents, dispersants, optical brighteners, anti-static agents, anti-wrinkling agents, odor-capturing agents, fiber protection agents, color protection agents, dyes/odorants, UV-protection agents, anti-pilling agents, water repellency agents, hardening agents/solubility modifers, glass and metal corrosion inhibitors, enzymes, anti-scaling agents, oxidizing agents, solvents, and insect repellants.

DETAILED DESCRIPTION OF THE INVENTION

This invention describes novel calcium sequestering compositions comprising mixtures of hydroxycarboxylic acid salts, at least one suitable oxoacid anion salt, and at least one citric acid salt. Hydroxycarboxylic acids are compounds which contain one or more hydroxyl groups as well as one or more carboxylic acid functionalities. A hydroxymonocarboxylic acid may be defined as a compound having only one carboxyl group. A hydroxydicarboxylic acid may be defined as a compound having two carboxyl groups. The hydroxyl groups of these compounds are capable of forming metal ion sequestering complexes when combined with suitable oxoacid anion salt. These complexes have been shown to form stable, water soluble complexes with metal ions such as calcium and magnesium, as opposed to hydroxycarboxylic acids alone which typically form water insoluble salts with many metal ions, thereby providing metal sequestering properties.

As used herein, the term "hydroxycarboxylic acid" can generally be considered any oxidation derivative of carbohydrates or other polyols, and should be construed to primarily include hydroxymonocarboxylic acids and hydroxydicarboxylic acids. Mixtures of hydroxycarboxylic acid suitable for use in this invention are also conveniently prepared by the oxidation of carbohydrate or other polyol compounds. Oxidation of carbohydrate compounds can be carried out in a variety of known methods, including oxidation with nitric acid, oxidation with nitrogen dioxide, oxidation with air or oxygen over metal catalysts, and oxidation with tetraalkylnitroxyl radical compounds such as TEMPO. The term polyol is generally defined as any organic compound with two or more alcohol hydroxyl groups. Suitable carbohydrates or polyols for oxidation include: simple aldoses and ketoses such as glucose, xylose or fructose; simple polyols such as glycerol, sorbitol or mannitol; reducing disaccharides such as maltose, lactose, or cellobiose; reducing oligosaccharides such as maltotriose, maltotetrose, or maltotetralose; nonreducing carbohydrates such as sucrose, trehalose and stachyose; mixtures of monosaccharides and oligosaccharides (that may include disaccharides); glucose syrups with different dextrose equivalent values; polysaccharides such as, but not limited to, starch, cellulose, arabinogalactans, xylans, mannans, fructans, hemicelluloses; mixtures of carbohydrates and other polyols that include one or more of the carbohydrates or polyols listed above. Specific examples of hydroxycarboxylic acids that may be used in the current invention include, but are not limited to, glucaric acid, xylaric acid, galactaric acid, gluconic acid, tartaric acid, tartronic acid, glycolic acid, glyceric acid, and combinations thereof. In one embodiment, the hydroxycarboxylic acid includes glucaric acid, xylaric acid, and galactaric acid. Additionally, one skilled in the art will appreciate that the hydroxycarboxylic acids of the current invention encompasses all conceivable stereoisomers, including diastereomers and enantiomers, in substantially pure form as well as in any mixing ratio, including the racemates of the hydroxycarboxylic acids.

The calcium sequestering compositions of the current invention comprise the salt form of the hydroxycarboxylic acids discussed herein. One of skill in the art will appreciate that salts are generally the compounds that arise from the neutralization reaction of an acid and a base. Any oxidation derivative of a carbohydrate or other polyol may be incorporated in its salt form into the current invention. Non-limiting examples of hydroxycarboxylic acid salts include disodium glucarate, sodium potassium glucarate, dipotassium glucarate, dilithium glucarate, lithium sodium glucarate, lithium potassium glucarate, zinc glucarate, diammonium glucarate, disodium xylarate, sodium potassium xylarate, dipotassium xylarate, dilithium xylarate, lithium sodium xylarate, lithium potassium xylarate, zinc xylarate, ammonium xylarate sodium gluconate, potassium gluconate, lithium gluconate, zinc gluconate, ammonium gluconate, disodium galactarate, sodium potassium galactarate, dipotassium galactarate, dilithium galactarate, lithium sodium galactarate, lithium potassium galactarate, zinc galactarate, diammonium galactarate, disodium tartrate, sodium potassium tartrate, dipotassium tartrate, dilithium tartrate, lithium sodium tartrate, lithium potassium tartrate, zinc tartrate, diammonium tartrate, disodium tartronate, sodium potassium tartronate, dipotassium tartronate, dilithium tartronate, lithium sodium tartronate, lithium potassium tartronate, zinc tartronate, diammonium tartronate, sodium glycolate, potassium glycolate, lithium glycolate, zinc glycolate, ammonium glycolate, sodium glycerate, potassium glycerate, lithium glycerate, zinc glycerate, ammonium glycerate, and combinations thereof. In another embodiment, the hydroxycarboxylic acid may include, but is not limited to, disodium glucarate, sodium potassium glucarate, dipotassium glucarate, zinc glucarate, disodium xylarate, sodium potassium xylarate, dipotassium xylarate, zinc xylarate, disodium galactarate, sodium potassium galactarate, dipotassium galactarate, zinc galactarate, diammonium xylarate, and combinations thereof.

As used herein, the term "oxoacid anion salt" is defined as any water soluble salt form of an acid containing at least one oxygen atom. The oxoacid anion salt may include, but is not limited to salts of borate, aluminate, stannate, germanate, molybdate, antimonate and combinations thereof. In one embodiment, the at least one suitable oxoacid anion salt comprises sodium borate, potassium borate, disodium octaborate, sodium metaborate, sodium molybdate, potassium molybdate, aluminum sulfate, aluminum nitrate, aluminum chloride, aluminum formate, sodium aluminate, aluminum bromide, aluminum fluoride, aluminum hydroxide, aluminum phosphate, aluminum iodide, aluminum sulphate, sodium stannate, potassium stannate, sodium germanate, potassium germanate, sodium antimonite, potassium antimonite, and combinations thereof. In yet another embodiment, the aluminum salt comprises sodium aluminate and aluminum chloride.

As used herein, the term "citric acid salt" is defined to include any salt forms of citric acid known within the art. Typically the citric acid salt is soluble in water. Citric acid salts are known to have metal sequestering properties, thus, any citric acid salt known in the art may be incorporated in the compositions of the current invention. Suitable examples of citric acid salts may include, but are not limited to sodium citrate, potassium citrate, calcium citrate, magnesium citrate, ammonium citrate and combinations thereof.

The calcium sequestering composition generally includes from about 25% to about 75% by weight of the at least one salt of hydroxymonocarboxylic acid or hydroxydicarboxylic acid, from about 1% to about 50% by weight of the at least one suitable oxoacid anion salt, and from about 1% to about 50% by weight of the at least one citric acid salt. The specific percentages of the at least one hydroxycarboxylic acid, the at least one suitable oxoacid anion salt, and the at least one citric acid salt may vary depending on the desired characteristics of the composition. Generally, compositions with various concentrations of the one or more hydroxycarboxylic acid salts, suitable oxoacid anion salts, and suitable citric acid salts have varying abilities to bind metal ions according to the pH of the medium from which the metal ion is bound. As such, depending on the pH of the desired medium to be treated with the calcium sequestering agent, the relative percentages of hydroxycarboxylic acid, suitable oxoacid anion salts, and suitable citric acid salts may vary. The calcium sequestering composition generally includes from about 25% to about 75% by weight of the at least one salt of hydroxycarboxylic acid, from about 1% to about 50% by weight of the at least one suitable oxoacid anion salt, and from about 1% to about 50% by weight of the at least one citric acid salt. In one embodiment, the composition includes from about 40% to about 60% by weight of the at least one salt of hydroxycarboxylic acid, from about 10% to about 35% by weight of the at least one suitable oxoacid anion salt, and from about 10% to about 35% by weight of the at least one citric acid salt. In one embodiment, the composition includes from about 45% to about 55% by weight of the at least one salt of hydroxycarboxylic acid, from about 15% to about 25% by weight of the at least one suitable oxoacid anion salt, and from about 15% to about 35% by weight of the at least one citric acid salt. In an additional embodiment, the composition comprises about 55% by weight of the at least one salt of hydroxycarboxylic acid, about 25% by weight of the at least one suitable oxoacid anion salt, and about 35% by weight of the at least one citric acid salt. In yet an additional embodiment, the composition comprises about 50% by weight of the at least one salt of hydroxycarboxylic acid, about 20% by weight of the at least one suitable oxoacid anion salt, and about 30% by weight of the at least one citric acid salt. In still yet an additional embodiment, the composition comprises about 45% by weight of the at least one salt of hydroxycarboxylic acid, about 15% by weight of the at least one suitable oxoacid anion salt, and about 25% by weight of the at least one citric acid salt.

One of skill in the art will appreciate that additional additives may be incorporated into the calcium sequestering compositions of the current invention, so long as the additives do not adversely impact the ability of the calcium sequestering compositions to sequester metal ions. Typical additives may include, but are not limited to organic detergents, cleaning agents, rinse aids, bleaching agents, sanitizers/anti-microbial agents, activators, detergent builders or fillers, defoaming agents, anti-redeposition agents, optical brighteners, dyes/odorants, additional hardening/solubility modifiers, surfactants, or any other natural or synthetic agent capable of altering the properties of the calcium sequestering composition.

The calcium sequestering compositions of the current invention may be utilized in any application that requires the sequestering or capture of metal ions. Suitable examples of industrial applications that could utilize the compositions of the current invention include, but are not limited to detergent builders, scale inhibitors for industrial water treatment purposes, and use as a renewable replacement for ethylenediaminetetraacetic acid (EDTA), nitrilotriacetic acid (NTA), sodium triployphosphate (STPP), and other common sequestering agents.

The hydroxycarboxylic acids of the current invention may be produced according to any methods currently known in the art. The currently employed commercial methods of preparation of the common hydroxycarboxylic acids or salts thereof are principally biologically induced transformations or fermentations, as for example in the production of tartaric acid (U.S. Pat. No. 2,314,831) and gluconic acid (U.S. Pat. No. 5,017,485). Chemical methods for oxidation also exist, although they are not as prevalent in commercial production. Some chemical oxidation methods suitable for polyol feedstocks include oxidation with oxygen over metal catalysts (U.S. Pat. No. 2,472,168) and oxidation mediated with tetraalkylnitroxyl radical compounds such as TEMPO (U.S. Pat. No. 6,498,269). Additional methods employ nitric acid as the oxidizing agent in aqueous solution and have been described (Kiely, U.S. Pat. No. 7,692,041). The skilled artisan will appreciate that any of the methods described herein, as well as any combination of the methods may be used to obtain the hydroxycarboxylic acid.

The oxidation of polyoly feedstocks, such as glucose will generally produce a mixture of oxidation products. For example, oxidation of glucose by any of the methods listed above will produce glucaric acid along with other oxidation products that include gluconic acid, glucaric acid, tartaric acid, tartronic acid, and glycolic acids, all of which are hydroxycarboxylic acids, and within the scope of the current invention. One of the prevalent hydroxycarboxylic acids produced by these oxidation methods includes glucaric acid. It is known within the art that the glucaric acid product in salt form may be selectively isolated from the mixture of other hydroxycarboxylic acids by titration with a base compound such as potassium hydroxide, and subsequently used as the hydroxycarboxylic acid component of the calcium sequestering compositions of the current invention. Such a composition, comprising glucaric acid as the hydroxycarboxylic acid, isolated from the remaining hydroxycarboxylic acids produced by the oxidation process, may be referred to as a "refined" glucarate composition. Alternatively, the mixture of hydroxycarboxylic acids produced by the oxidation of glucose may be used as the hydroxycarboxylic acid component of the compositions of the current invention, without isolating the glucaric acid component. Such a mixture is referred to as an "unrefined" glucarate composition. Accordingly, the unrefined glucarate composition comprises a mixture of one or more hydroxycarboxylic acids produced by the oxidation of a feedstock, and may include gluconic acid, 5-keto-gluconic acid, glucaric acid, tartaric acid, tartronic acid, and glycolic acids. The use of an unrefined glucarate mixture as the hydroxycarboxylic acid component of the current compositions provides multiple advantages over the prior art, including cost-efficiencies due to the reduced number of processing steps, as well as an increase in product yield.

The current invention also comprises methods of sequestering calcium from various mediums with varying pH levels. It will be understood by the skilled artisan that any medium, including, but not limited liquids, gels, semi-solids, and solids may be treated with the calcium sequestering compositions of the current invention. Generally, compositions of the current invention are effective due to the fact that the at least one hydroxycarboxylic acid and the at least one oxoacid anion salt form a complex that is suitable for sequestering metal ions. The formation of the hydroxycarboxylate/oxoacid anion complex is pH dependent, such that the complex forms more readily as the pH increases, and calcium sequestration generally improves as pH increases. Additionally, glucarate is thought to provide the best alternative for sequestering calcium ions due to the structural characteristics of the compound. Moreover, the citric acid salt is capable of sequestering metal ions from a variety of mediums; however, the sequestering ability of the citric acid does not improve in the presence of oxoacid anions as observed with glucarate likely due to the fact that it has only one hydroxyl group and is not capable of forming a diester complex. Surprisingly, it has been discovered that the combination of one or more hydroxycarboxylic acid salts, one or more suitable oxoacid anion salts, and one or more citric acid salts synergistically binds metal ions. Specifically, the calcium sequestering compositions of the current invention bind calcium ions to an extent that is significantly greater than would be expected if the chelating capacity of the hydroxycarboxylate/aluminate and the chelating capacity of the citrate were only additive.

It is noted that the calcium sequestering compositions of the current invention may be used to sequester calcium ions from mediums having a variety of pH levels. Generally, the compositions may be used to sequester calcium ions from a medium with a pH ranging from about 6 to about 14. In one embodiment, the current invention provides a method of sequestering calcium ions from a medium having a pH ranging from about 8.5 to about 11.5, comprising the administration of a composition comprising a combination of at least one salt of a hydroxycarboxylic acid, at least one suitable oxoacid anion salt, and at least one suitable citric acid salt. The at least one salt of a hydroxycarboxylic acid may include a salt of glucaric acid, a salt of gluconic acid, a salt of 5-keto-gluconic acid, a salt of tartaric acid, a salt of tartronic acid, a salt of glycolic acid, a salt of xylaric acid, a salt of galactaric acid, and combinations thereof. In one embodiment, the at least one salt of a hydroxycarboxylic acid may include a mixture of at least one glucarate salt, at least one gluconate salt, at least one 5-keto-gluconate salt, at least one tartrate salt, at least one glycolate salt, and at least one tartronate salt.

In one embodiment, the mixture of hydroxycarboxylic acids may include about 30% to about 75% of the at least one glucarate salt, about 0% to about 20% of the at least one gluconate salt, about 0% to about 10% of the at least one 5-keto-gluconate salt, about 0% to about 10% of the at least one tartrate salt, about 0% to about 10% of the at least one tartronate salt, and about 0% to about 10% of the at least one glycolate salt. In another embodiment, the mixture comprises about 40% to about 60% of the at least one glucarate salt, about 5% to about 15% of the at least one gluconate salt, about 3% to about 9% of the at least one 5-keto-gluconate salt, about 5% to about 10% of the at least one tartrate salt, about 5% to about 10% of the at least one tartronate salt, and about 1% to about 5% of the at least one glycolate salt. In yet another embodiment, the mixture includes about 45% to about 55% of the at least one glucarate salt, about 10% to about 15% of the at least one gluconate salt, about 4% to about 6% of the at least one 5-keto-gluconate salt, about 5% to about 7% of the at least one tartrate salt, about 5% to about 7% of the at least one tartronate salt, and about 3% to about 5% of the at least one glycolate salt. In still another embodiment, the mixture includes about 50% of the at least one glucarate salt, about 15% of the at least one gluconate salt, about 4% of the at least one 5-keto-gluconate salt, about 6% of the at least one tartrate salt, about 6% of the at least one tartronate salt, and about 5% of the at least one glycolate salt. It is noted that the percentages of all hydroxycarboxylates are based on the total weight of the hydroxycarboxylate component in calcium sequestering composition and do not include the additional weight of the suitable oxoacid anion salt and the citric acid salt.

Generally, the method of sequestering calcium ions from a medium having a pH ranging from about 6 to about 14 comprises the use of a calcium sequestering composition including from about 25% to about 75% by weight of the at least one salt of hydroxycarboxylic acid, from about 1% to about 50% by weight of the at least one suitable oxoacid anion salt, and from about 1% to about 50% by weight of the at least one citric acid salt. In one embodiment, the composition includes from about 40% to about 60% by weight of the at least one salt of hydroxycarboxylic acid, from about 10% to about 35% by weight of the at least one suitable oxoacid anion salt, and from about 10% to about 40% by weight of the at least one citric acid. In a further embodiment, the composition includes from about 45% to about 55% by weight of the at least one salt of hydroxycarboxylic acid, from about 15% to about 25% by weight of the at least one suitable oxoacid anion salt, and from about 25% to about 35% by weight of the at least one citric acid. In an additional embodiment, the composition comprises about 50% by weight of the at least one salt of hydroxycarboxylic acid, about 20% by weight of the at least one suitable oxoacid anion salt, and about 30% by weight of the at least one citric acid salt.

The current invention also comprises detergent compositions comprising the calcium sequestering compositions of the present invention, and as described above. The detergent compositions may contain one or more functional materials that provide desired properties and functionalities to the detergent compositions. For the purpose of this application, the term "functional materials" includes a material that when dispersed or dissolved in a use and/or concentrate solution, such as an aqueous solution, provides a beneficial property in a particular use. Examples of such functional materials include, but are not limited to: organic detergents, cleaning agents; rinse aids; bleaching agents; sanitizers/anti-microbial agents; activators; detergent builders or fillers; defoaming agents, anti-redeposition agents; optical brighteners; dyes/odorants; secondary hardening agents/solubility modifiers; pesticides for pest control applications; or the like, or a broad variety of other functional materials, depending upon the desired characteristics and/or functionality of the detergent composition.

The functional material may be a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

The functional material may be a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition. The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

The functional material may be a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

In some embodiments, the antimicrobial activity or bleaching activity of the detergent compositions can be enhanced by the addition of a material which, when the detergent composition is placed in use, reacts with the active oxygen to form an activated component. For example, in some embodiments, a peracid or a peracid salt is formed. For example, in some embodiments, tetraacetylethylene diamine can be included within the detergent composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

The functional material may be a detergent filler, which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and $C_1$-$C_{10}$ alkylene glycols such as propylene glycol.

The detergent compositions can be formulated such that during use in aqueous operations, for example in aqueous cleaning operations, the wash water will have a desired pH. For example, compositions designed for use in providing a presoak composition may be formulated such that during use in aqueous cleaning operations the wash water will have a pH in the range of about 6.5 to about 12, and in some embodiments, in the range of about 7.5 to about 11. Liquid product formulations in some embodiments have a (10% dilution) pH in the range of about 7.5 to about 11.0, and in some embodiments, in the range of about 7.5 to about 9.0.

For example, a souring agent may be added to the detergent compositions such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids.

The functional material may be a fabric relaxant added to the detergent compositions to increase the smoothness appearance of the surface of the textile. A fabric softener may be added to the detergent compositions to soften the feel of the surface of the textile.

The functional material may be a soil releasing agent that can be provided for coating the fibers of textiles to reduce the tendency of soils to attach to the fibers.

The functional material may be a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate.

The functional material may be an anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, polyacrylates, styrene maleic anhydride copolymers, and cellulosic derivatives such as hydroxyethyl cellulose, hydroxypropyl cellulose.

The functional material may be a stabilizing agent. Examples of suitable stabilizing agents include, but are not limited to: borate, calcium/magnesium ions, propylene glycol, and mixtures thereof.

The functional material may be a dispersant. Examples of suitable dispersants that can be used in the detergent compositions include, but are not limited to: maleic acid/olefin copolymers, polyacrylic acid, and mixtures thereof.

The functional material may be an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. Preferably, the individual components of such a brightener mixture are compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

The functional material may be an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

The functional material may be an anti-wrinkling agent to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes.

The functional material may be an odor capturing agent. In general, odor capturing agents are believed to function by capturing or enclosing certain molecules that provide an odor. Examples of suitable odor capturing agents include, but are not limited to: cyclodextrins and zinc ricinoleate.

The functional material may be a fiber protection agent that coats the fibers of a textile to reduce or prevent disintegration and/or degradation of the fibers. An example of a fiber protection agent includes, but is not limited to, cellulosic polymers.

The functional material may be a color protection agent for coating the fibers of a textile to reduce the tendency of dyes to escape the textile into water. Examples of suitable color protection agents include, but are not limited to: quaternary ammonium compounds and surfactants.

Various dyes, odorants including perfumes, and other aesthetic enhancing agents may also be included in the detergent compositions. Examples of suitable fragrances or perfumes include, but are not limited to: terpenoids such as citronellol, aldehydes such as amyl cinnamaldehyde, a jasmine such as C1S-jasmine or jasmal, and vanillin.

The functional material may be a UV protection agent to provide a fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned.

The functional material may be an anti-pilling agent that acts on portions of fibers that stick out or away from the fiber. Anti-pilling agents can be available as enzymes such as cellulase enzymes.

The functional material may be a water repellency agent that can be applied to textile to enhance water repellent properties. Examples of suitable water repellenancy agents include, but are not limited to: perfluoroacrylate copolymers, hydrocarbon waxes, and polysiloxanes.

The functional material may be a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

The functional material may be a metal corrosion inhibitor in an amount up to approximately 30% by weight, up to approximately 6% by weight, and up to approximately 2% by weight. The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. Examples of suitable corrosion inhibitors include, but are not limited to: an alkaline metal silicate or hydrate thereof.

An effective amount of an alkaline metal silicate or hydrate thereof can be employed in the compositions and processes of the invention to form a stable solid detergent composition having metal protecting capacity. The silicates employed in the compositions of the invention are those that have conventionally been used in solid detergent formulations. For example, typical alkali metal silicates are those powdered, particulate or granular silicates which are either anhydrous or preferably which contain water of hydration (approximately 5% to approximately 25% by weight, particularly approximately 15% to approximately 20% by weight water of hydration). These silicates are preferably sodium silicates and have a $Na_2O:SiO_2$ ratio of approximately 1:1 to approximately 1:5, respectively, and typically contain available water in the amount of from approximately 5% to approximately 25% by weight. In general, the silicates have a $Na_2O:SiO_2$ ratio of approximately 1:1 to approximately 1:3.75, particularly approximately 1:1.5 to approximately 1:3.75 and most particularly approximately 1:1.5 to approximately 1:2.5. A silicate with a $Na_2O:SiO_2$ ratio of approximately 1:2 and approximately 16% to approximately 22% by weight water of hydration, is most preferred. For example, such silicates are available in powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, a $Na_2O:SiO_2$ ratio of approximately 1:1.5 to approximately 1:2.5, have been found to provide the optimum metal protection and rapidly form a solid detergent.

Silicates can be included in the detergent composition to provide for metal protection but are additionally known to provide alkalinity and additionally function as anti-redeposition agents. Exemplary silicates include, but are not limited to: sodium silicate and potassium silicate. The detergent composition can be provided without silicates, but when silicates are included, they can be included in amounts that provide for desired metal protection. The concentrate can include silicates in amounts of at least approximately 1% by weight, at least approximately 5% by weight, at least approximately 10% by weight, and at least approximately 15% by weight. In addition, in order to provide sufficient room for other components in the concentrate, the silicate component can be provided at a level of less than approximately 35% by weight, less than approximately 25% by weight, less than approximately 20% by weight, and less than approximately 15% by weight.

The functional material may be an enzyme. Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 10% by weight, up to approximately 5% by weight, and up to approximately 1% by weight.

The functional material may be an anti-scaling agent. In one embodiment, the anti-scaling agent comprises about 0.25 wt % to about 10 wt % of the detergent composition. In some embodiments, the anti-scaling agent comprises about 2 to about 5 wt % of the detergent composition. In still yet other embodiments, the anti-scaling agent comprises about 0.5 to about 1.5 wt % of the detergent composition. It is to be understood that all values and ranges between these values and ranges are encompassed by the present invention.

In some embodiments, an effective amount of anti-scaling agent is applied to industrial food processing equipment such that the scale on the equipment is substantially removed. In some embodiments, at least about 10% of scale deposition is removed from the equipment. In other embodiments, at least about 25% of scale deposition is removed. In still yet other embodiments, at least about 50% of scale deposition is removed. In some embodiments, about 90% of scale deposition is removed.

In some embodiments, an effective amount of anti-scaling agent is applied to industrial food processing equipment such that formation of scale on the equipment is substantially prevented. In some embodiments, at least about 10% of scale deposition is prevented. In other embodiments, at least about 25% of scale deposition is prevented. In still yet other embodiments, at least about 50% of scale deposition is prevented. In some embodiments, about 90% of scale deposition is prevented.

The functional material may be an oxidizing agent or an oxidizer, such as a peroxide or peroxyacid. Suitable ingredients are oxidants such as chlorites, bromine, bromates, bromine monochloride, iodine, iodine monochloride, iodates, permanganates, nitrates, nitric acid, borates, perborates, and gaseous oxidants such as ozone, oxygen, chlorine dioxide, chlorine, sulfur dioxide and derivatives thereof. Peroxygen compounds, which include peroxides and various percarboxylic acids, including percarbonates, are suitable.

Peroxycarboxylic (or percarboxylic) acids generally have the formula $R(CO_3H)_n$, where, for example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula $R(CO_3H)_n$, where R is a $C_5$-$C_{11}$ alkyl group, a $C_5$-$C_{11}$ cycloalkyl, a $C_5$-$C_{11}$ arylalkyl group, $C_5$-$C_{11}$ aryl group, or a $C_5$-$C_{11}$ heterocyclic group; and n is one, two, or three. Short chain fatty acids can have the formula $R(CO_3H)_n$ where R is $C_1$-$C_4$ and n is one, two, or three.

Examples of suitable peroxycarboxylic acids include, but are not limited to: peroxypentanoic, peroxyhexanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like.

Examples of suitable branched chain peroxycarboxylic acid include, but are not limited to: peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like.

Typical peroxygen compounds include hydrogen peroxide ($H_2O_2$), peracetic acid, peroctanoic acid, a persulphate, a perborate, or a percarbonate.

The amount of oxidant in the detergent composition, if present, is up to approximately 40 wt %. Acceptable levels of oxidant are up to approximately 10 wt %, with up to approximately 5% being a particularly suitable level.

The functional material may be a solvent to enhance soil removal properties or to adjust the viscosity of the final composition. Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

When a solvent is included in the detergent composition, it may be included in an amount of up to approximately 25% by weight, particularly up to approximately 15% by weight and more particularly up to about 5% by weight.

The functional material may be an insect repellent such as mosquito repellent. An example of a commercially available insect repellent is DEET. In addition, the aqueous carrier solution can include mildewcides that kill mildew and allergicides that reduce the allergic potential present on certain textiles and/or provide germ proofing properties.

A wide variety of other ingredients useful in providing the particular detergent composition being formulated to include desired properties or functionality may also be included. For example, the detergent compositions may include other active ingredients, cleaning enzyme, carriers, processing aids, solvents for liquid formulations, or others, and the like.

The detergent compositions can be used, for example, in vehicle care applications, warewashing applications, laundering applications and food and beverage applications. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners.

The compounds and processes of the invention will be better understood by reference to the following examples, which are intended as an illustration of and not a limitation upon the scope of the invention. Each example illustrates at least one method of preparing various intermediate compounds and further illustrates each intermediate utilized in the overall process. These are certain preferred embodiments, which are not intended to limit the present invention's scope. On the contrary, the present invention covers all alternatives, modifications, and equivalents as can be included within the scope of the claims and routine experimentation.

Example 1

Calcium Sequestration from Water

The calcium chelating ability of various compounds and mixtures was determined by an established turbidity titration procedure (Wilham, 1971). Specifically, the sequestering agent (1.0 g dry weight) was dissolved in deionized water to give a 50 g total solution. Following the addition of 2% aqueous sodium oxalate (3 mL), the pH was adjusted accordingly using either dilute HCI or 1M sodium hydroxide solution. The test solution was titrated to incipient turbidity with 0.7% aqueous calcium chloride. Each mL of 0.7% calcium chloride added is equivalent to 2.53 mg of Ca sequestered. The combined sequestering agent (c) exhibits synergy in those compositions where the calcium sequestration exceeds the value of either component alone.

The calcium sequestering capacity of the component (a) and component (b) are measured separately. Subsequently, the sequestering capacity of mixed component (c) prepared by combining components (a) and (b) in the given proportions is measured using turbidity titration under the same conditions.

As noted above, if the sequestering capacity is greater than the sequestering capacity of either component (a) or (b) alone, the combination of components (a) and (b) is considered synergistic. Additionally, the unrefined glucarate/aluminate component signifies a combination comprising glucarate, gluconate, 5-ketogluconate, tartrate, tartronate, glycolate and aluminate, whereas the refined glucarate/aluminate component signifies a combination including only glucarate and aluminate. The results of this experiment are illustrated in Tables 1-13 below. In all cases, the amount of anion sequestering agent used is calculated as the sodium salt.

TABLE 1

| Sequestering Agent | mg Ca/g Sequestering Agent |
|---|---|
| (a) Glucarate/Aluminate | 143.0 |
| (b) Citrate | 63.1 |
| (c) Glucarate/Aluminate/Citrate (a = 65%; b = 35%) | 147.7 |

TABLE 2

| Sequestering Agent | mg Ca/g Sequestering Agent |
|---|---|
| (a) Unrefined Glucarate/Aluminate | 116.7 |
| (b) Citrate | 63.1 |
| (c) Unrefined Glucarate/Aluminate/Citrate (a = 64%; b = 36%) | 130.1 |

TABLE 3

| Sequestering Agent | mg Ca/g Sequestering Agent |
|---|---|
| (a) Unrefined Glucarate/Aluminate | 116.7 |
| (b) Citrate | 63.1 |
| (c) Unrefined Glucarate/Aluminate/Citrate (a = 43%; b = 57%) | 94.0 |

TABLE 4

| Sequestering Agent | mg Ca/g Sequestering Agent |
|---|---|
| (a) Gluconate/Aluminate | 70.9 |
| (b) Citrate | 63.1 |
| (c) Gluconate/Aluminate/Citrate (a = 64%; b = 36%) | 69.5 |

TABLE 5

| Sequestering Agent | mg Ca/g Sequestering Agent |
|---|---|
| (a) Tartrate/Aluminate | 40.5 |
| (b) Citrate | 63.1 |
| (c) Tartrate/Aluminate/Citrate (a = 68%; b = 32%) | 61.1 |

TABLE 6

| Sequestering Agent | mg Ca/g Sequestering Agent |
|---|---|
| (a) Glycolate/Aluminate | 8.5 |
| (b) Citrate | 63.1 |
| (c) Glycolate/Aluminate/Citrate (a = 67%; b = 33%) | 49.7 |

TABLE 7

| Sequestering Agent | mg Ca/g Sequestering Agent |
|---|---|
| (a) Unrefined Glucarate/Aluminate | 116.7 |
| (b) EDTA | 118.8 |
| (c) Unrefined Glucarate/Aluminate/EDTA (a = 64%; b = 36%) | 94.1 |

TABLE 8

| Sequestering Agent | mg Ca/g Sequestering Agent |
|---|---|
| (a) Unrefined Glucarate/Aluminate | 116.7 |
| (b) NTA | 131.1 |
| (c) Unrefined Glucarate/Aluminate/NTA (a = 50%; b = 50%) | 131.6 |

TABLE 9

| Sequestering Agent | mg Ca/g Sequestering Agent |
|---|---|
| (a) Unrefined Glucarate/Borate | 43.3 |
| (b) Citrate | 63.1 |
| (c) Unrefined Glucarate/Borate/Citrate (a = 64%; b = 36%) | 68.4 |

TABLE 10

| Sequestering Agent | mg Ca/g Sequestering Agent |
|---|---|
| (a) Unrefined Glucarate | 8.1 |
| (b) Citrate | 63.1 |
| (c) Unrefined Glucarate/Citrate (a = 64%; b = 36%) | 37.9 |

TABLE 11

| Sequestering Agent | mg Ca/g Sequestering Agent |
|---|---|
| (a) Glucarate | 27.2 |
| (b) Citrate | 63.1 |
| (c) Glucarate/Citrate (a = 66%; b = 34%) | 48.2 |

TABLE 12

| Sequestering Agent | mg Ca/g Sequestering Agent |
|---|---|
| (a) Aluminate | 3.8 |
| (b) Citrate | 63.1 |
| (c) Aluminate/Citrate (a = 24%; b = 76%) | 59.8 |

TABLE 13

| Sequestering Agent | mg Ca/g Sequestering Agent |
|---|---|
| (a) Borate | 10.9 |
| (b) Citrate | 63.1 |
| (c) Borate/Citrate (a = 18%; b = 82%) | 52.2 |

As evident from the data in the Tables above, refined glucarate/aluminate and citrate, unrefined glucarate/aluminate and citrate, and unrefined glucarate/borax and citrate combinations demonstrate an unpredictable synergistic increase in calcium sequestering capacity above either of the sequestering agents alone. The sequestering capacities of unrefined glucarate and citrate, and aluminate and citrate provided in Tables 10 and 12 are at a level that would be expected, providing evidence that synergistic performance does not solely rely on those combinations. Rather, synergistic performance relies on a sequestering agent with a constituency of all three types of components; a hydroxymonocarboxylate and/or hydroxydicarboxylate, an oxoacid anion, and citrate. It is further noted in Tables 7 and 8 that this phenomenon is specific to citrate and not extended to other common chelators such as EDTA and NTA.

REFERENCES

Abbadi, A.; Gotlieb, K. F.; Meiberg, J. B. M.; Peters, J. A.; van Bekkum, H. New Ca-Sequestering Materials Based on the Oxidation of the Hydrolysis Products of Lactose. *Green Chem.* 1999, 231-235.

Wilham, C. A.; Mehltretter, C. L. Organic Acids as Builders in Linear Alkylbenzene Sulfonate Detergent Formulations. *J. Am. Oil Chem. Soc.* 1971, 48(11), 682-683.

Lowe, E. J.; Adair, W. D.; Johnston, E. Soaps and Detergents—The Inorganic Components. *J. Am. Oil Chem. Soc.* 1978, 55, 32-35.

van Duin, Martin; Peters, Joop A.; Kieboom, Antonius, P. G.; van Bekkum, Herman. Synergic Coordination of Calcium in Borate-Polyhydroxycarboxylate Systems. *Carb. Res.* 1987, 162, 65-78 van Duin, Martin; van Bekkum, Herman. Studies on borate esters. Part 8. Interactions of cations. *J. Chem. Soc. Dalton Trans.* 1987, 8, 2051-2057

What is claimed is:

1. A calcium sequestering composition comprising a combination of:

(a) about 40% to about 60% by weight of at least one gluconate salt, about 5% to about 15% by weight of at least one gluconate salt, about 3% to about 9% by weight of at least one 5-keto-gluconate salt, about 5% to about 10% by weight of at least one tartrate salt, about 5% to 10% by weight of at least one tartronate salt, and about 1% to 5% by weight of at least one glycolate salt;

(b) from about 1% to about 50% by weight of at least one oxoacid anion salt; and, (c) from about 1% to about 50% by weight of at least one citric acid salt, wherein the salts of (a) are fully neutralized.

2. The calcium sequestering composition of claim 1, wherein the composition comprises about 45% to about 55% by weight of the at least one glucarate salt, about 10% to about 15% by weight of the at least one gluconate salt, about 4% to about 6% by weight of the at least one 5-keto-gluconate salt, about 5% to about 7% by weight of the at least one tartrate salt, about 5% to 7% by weight of the at least one tartronate salt, and about 3% to 5% by weight of the at least one glycolate salt.

3. The calcium sequestering composition of claim 1, wherein the composition comprises about 50% by weight of the at least one glucarate salt, about 15% by weight of the at least one gluconate salt, about 4% by weight of the at least one 5-keto-gluconate salt, about 6% by weight of the at least one tartrate salt, about 6% by weight of the at least one tartronate salt, and about 5% by weight of the at least one glycolate salt.

4. The calcium sequestering composition of claim 1, wherein the oxoacid anion salt comprises a salt of borate, aluminate, stannate, germanate, molybdate, antimonate, or a mixture thereof.

5. The calcium sequestering composition of claim 1, wherein the at least one oxoacid anion salt comprises sodium borate, potassium borate, disodium octaborate, sodium metaborate, sodium molybdate, potassium molybdate, sodium aluminate, potassium aluminate, aluminum chloride sodium stannate, potassium stannate, sodium germanate, potassium germanate, sodium antimonite, potassium antimonite, or a mixture thereof.

6. The calcium sequestering composition of claim 1, wherein the at least one citric acid salt comprises sodium citrate, potassium citrate, calcium citrate, magnesium citrate, or a mixture thereof.

7. A detergent composition comprising (a) about 40% to about 60% by weight of at least one glucarate salt, about 5% to about 15% by weight of at least one gluconate salt, about 3% to about 9% by weight of at least one 5-keto-gluconate salt, about 5% to about 10% by weight of at least one tartrate salt, about 5% to 10% by weight of at least one tartronate salt, and about 1% to 5% by weight of at least one glycolate salt;

(b) from about 1% to about 50% by weight of at least one oxoacid anion salt; and, (c) from about 1% to about 50% by weight of at least one citric acid salt, wherein the salts of (a) are fully neutralized.

8. The detergent composition of claim 7, further comprising one or more additional functional materials, each independently selected from the group consisting of rinse aids, bleaching agents, sanitizers, anti-microbial agents, activators, detergent builders or fillers, pH buffering agents, fabric relaxants, fabric softeners, soil releasing agents, defoaming agents, anti-redeposition agents, stabilizing agents, dispersants, optical brighteners, anti-static agents, anti-wrinkling agents, odor-capturing agents, fiber protection agents, color protection agents, dyes, odorants, UV-protection agents, anti-pilling agents, water repellency agents, hardening agents, solubility modifiers, glass and metal corrosion inhibitors, enzymes, anti-scaling agents, oxidizing agents, solvents, and insect repellants.

9. The detergent composition of claim 7, wherein the oxoacid anion salt comprises a salt of borate, aluminate, stannate, germanate, molybdate, antimonate, or a mixture thereof.

10. The detergent composition of claim 7, wherein the at least one oxoacid anion salt comprises sodium borate, potassium borate, disodium octaborate, sodium metaborate, sodium molybdate, potassium molybdate, sodium aluminate, potassium aluminate, aluminum chloride sodium stannate, potassium stannate, sodium germanate, potassium germanate, sodium antimonite, potassium antimonite, or a mixture thereof.

11. The detergent composition of claim 7, wherein the at least one citric acid salt comprises sodium citrate, potassium citrate, calcium citrate, magnesium citrate, or a mixture thereof.

* * * * *